United States Patent [19]

Franklin

[11] Patent Number: 4,629,101

[45] Date of Patent: Dec. 16, 1986

[54] DISPLAY DEVICES FOR ARTICLES OF CLOTHING

[75] Inventor: Robert J. Franklin, Buckinghamshire, England

[73] Assignee: Marks and Spencer p.l.c., United Kingdom

[21] Appl. No.: 708,293

[22] Filed: Mar. 5, 1985

[30] Foreign Application Priority Data

Mar. 23, 1984 [GB] United Kingdom ..... 8407556

[51] Int. Cl.[4] ..... B65B 15/00; B65D 57/00

[52] U.S. Cl. ..... 223/66; 223/84; 223/87; 206/292; 206/495

[58] Field of Search ..... 223/37, 66, 71, 84, 223/87; 53/117, 429; 206/292, 293, 296, 297, 299, 492, 495

[56] References Cited

U.S. PATENT DOCUMENTS

| | | | |
|---|---|---|---|
| 1,955,244 | 4/1934 | Liebowitz | 223/37 |
| 2,597,904 | 5/1952 | Simonsen | 223/71 |
| 3,252,565 | 5/1966 | Abbey | 223/87 X |
| 3,391,839 | 7/1968 | Gwinn et al. | 53/117 X |
| 4,134,524 | 1/1979 | Nakano et al. | 223/37 X |
| 4,248,363 | 2/1981 | Zuckerman et al. . | |

FOREIGN PATENT DOCUMENTS

| | | | |
|---|---|---|---|
| 2388534 | 12/1978 | France | 223/66 |
| 642144 | 7/1962 | Italy | 223/37 |
| 1175616 | 12/1969 | United Kingdom . | |
| 1341561 | 12/1973 | United Kingdom . | |
| 1381438 | 1/1975 | United Kingdom . | |
| 2058001 | 4/1981 | United Kingdom . | |
| 2074023 | 12/1984 | United Kingdom . | |
| 2120542 | 6/1985 | United Kingdom . | |

*Primary Examiner*—Robert R. Mackey

*Attorney, Agent, or Firm*—Lerner, David, Littenberg Krumholz & Mentlik

[57] ABSTRACT

In order to maintain the shape of a folded garment, and to hold it in the folded position, there is provided a display device comprising a first support element adapted to extend across the shoulders of the garment at the back, a second support element adapted to enter the neck of the garment in the area of the shoulders so as to hold the garment in position, and a pair of bars about which the sleeves may be folded so as to lie generally parallel with the sides of the garments and with each other. The support element also includes a pair of clips or latches which retain a lower marginal portion of the garment when the latter is folded up. For particular effectiveness in maintaining the shape and ease of folding, there is preferably also provided a generally rectangular frame comprising side frame elements and a bottom frame element which assists in the folding up of the lower marginal portion.

8 Claims, 9 Drawing Figures

DISPLAY DEVICES FOR ARTICLES OF CLOTHING

This invention relates to display devices for articles of clothing.

When clothing is exposed for sale on a counter, it is preferred that the articles be kept separate and folded to maintain the shape of the articles to display them to best advantage.

Knitwear, such as sweaters, is normally folded and packed in bags of clear film, and customers have access by opening the bags, which have peelable closures for the purpose. Unfortunately, the clear film used is rather glossy and hence the reflected light tends to obscure the colour of the packed garment. Accordingly, customers have a clear need to open the bag to inspect the garment. Many customers remove the garments from the bags and frequently do not put them back, or even refold them. This leads to a need for refolding and replacing by store staff and there is a possibility that garments and bags may be mismatched, which may lead to sizing errors and customer dissatisfaction.

Shirts are normally packed on support cards, and secured to them by pins or clips, the packaging also normally including a collar support. The act of packaging itself is fairly time-consuming and involves accurate location of pins and/or clips.

In the case of both shirts and sweaters, it is normal for the folding to include folding the sleeves backward and inward from the shoulder position and then turning them down on an oblique fold so as to lie generally parallel with the sides of the garment and each other. The garment is then folded up rearwardly, with the sleeves, so that the lower part of the garment is behind the upper part. When packaging shirts, pins or clips are used to maintain the shirt in this position, normally with a card insert to maintain the shape of the shirt. Knitwear is normally loosely folded.

Cardigans, however, are usually rather differently folded, the sleeves being folded generally across the garment. The present invention also relates to a display device for such garments, or for sleeveless garments.

In accordance with the invention, there is provided a garment display device comprising a first support element adapted to pass across the shoulders of a garment outside a neck aperture, a pair of second support elements attached to the first support element and adapted to pass through the neck aperture of the garment and one inside each shoulder zone, and latch or clip means mounted on or adjacent to the first support element to receive and retain an upwardly folded lower region of the garment The present invention as defined above is to be distinguished from known garment display hangers utilising attachment clips and from known garment display cards or frames, optionally with hanging hooks, facilitating folding and display of shirts.

Examples of the first-named category are shown in UK Patent Specifications Nos. 2,074,023, 1,175,616 and U.S. Pat. No. 4,248,363, or in UK Patent Specification No. 2,120,542 in a different manner. In the first three of these, the generally conventional sloping or arcuate top bar of a clothes hanger is placed inside the shoulders of a garment, such as or jacket and spaced clips e.g. along a transverse cross-bar are used to support usually another garment such as a shirt or trousers or possibly a fold in the first garment. The top bar passes within (not across the outside of) the shoulders, and is not associated with any secondary support elements to locate and display the neck and shoulder areas especially. In U.K. Patent Specification No. 2,120,542, an adjustable skirt or like hanger is formed with a telescopic transverse member provided with end clips. Here again, the known hanger does not provide either a first support across garment shoulders or second supports within such shoulders.

Examples of the second category are shown in U.K. Patent Specifications Nos. 1,341,561, 1,381,438 and 2,058,001. None of these show a first support element across the shoulders and second support elements within the neck aperture and inside the shoulders. None of them moreover show latches or clips to receive or retain an upwardly folded lower region as utilized in the present invention.

All of them show display cards or frames specifically for shirts in which the primary location point is within the two folded leaves of a relatively firm shirt collar, but not within the neck aperture and inside each shoulder zone. Also, the retention of any folded region is effected only by a simple fold-over line, or by a buttoning point, both on a median line. Both of these features are suitable for lightweight but firmly creased shirt material; neither is suitable for heavier, bulkier or looser knitted material without a formed collar.

Thus, the valuable combination of a first support across the shoulders(which usually generally defines the overall displayed width), second supports within shoulders (e.g. to locate and display the neck region especially for softer, bulkier material) and positive receiving latches or clips for folded portions (again especially suitable for heavier materials) is not hitherto shown in the prior art.

The invention can be embodied in several ways.

Thus, there may be provided a pair of rigid or hinged bars attached to the first support element and having a position so as to define a fold line for return folding of a sleeve.

For example, for a display device suitable for a sweater, the rigid or hinged bars, over at least part of their length, have an oblique orientation such that the sleeve can be return folded into substantially parallel relationships with a side of the garment and with the other sleeve.

However, a display device more suitable for a cardigan would possess rigid or hinged bars which over at least part of their length extend substantially vertically down from the shoulder zone such that the sleeve can be return folded, using the bar as a fold indication, generally across the garment.

Whether or not such bars are provided, it is possible to extend the first support element downwardly from its shoulder zone to form a frame including a bottom bar to define a fold line for upward folding of the garment to bring a lower portion of the garment towards the latch or clip means. Clearly, if no bars, oblique or vertical, exists to define sleeve fold lines, such a display device is more suitable for a sleeveless garment.

The said second support elements can be rigidly or hingedly mounted on the first support element.

The garment display device is conveniently integrally moulded in a plastic material with the property of forming integral hinges, particularly polypropylene. Other materials may be used. One advantage of the use of such materials is that latches or clips may be integrally moulded generally in the plane of the display device, and then bent out from that plane to act as latches or clips.

The clips used in the display device are mounted on, or adjacent to, the first support element. By "adjacent" to such element is usually meant that they can be attached to or integral with the rigid or hinged sleeve-fold bars.

The device may also include a collar support for a shirt. By using a device of this nature, garments may be displayed in a folded form and the garment shape is substantially retained without the need for enclosing bags.

The invention will be further described with reference to the accompanying drawings, in which.

Figure 1:
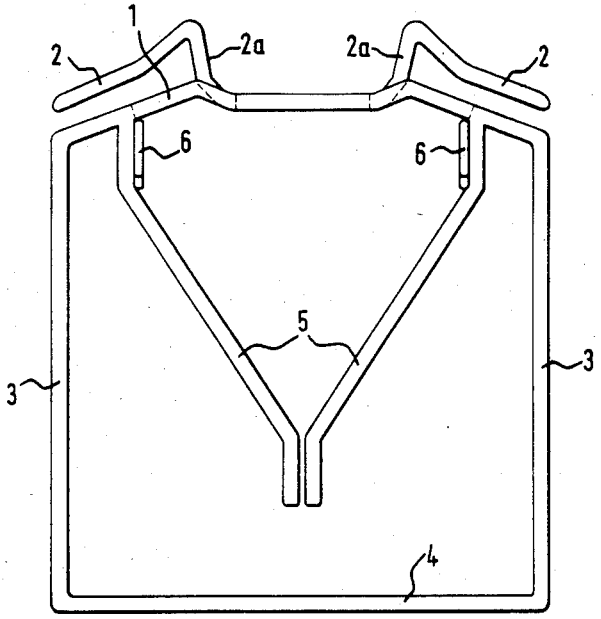
FIG. 1 is an elevational view of a display device according to the one form of the invention illustrated in its normal position of use.
Figure 2:
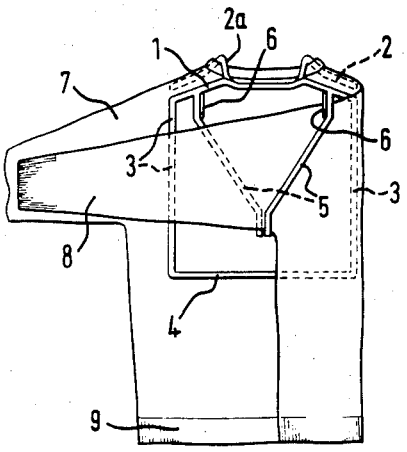
FIG. 2 shows the display device of FIG. 1 in conjunction with a garment at an early stage of folding.
Figure 3:
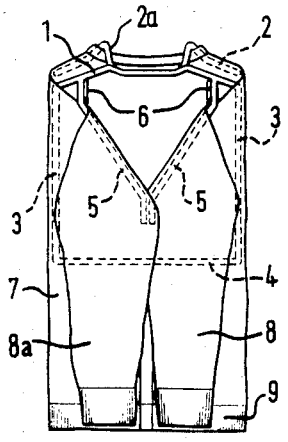
FIG. 3 is a view similar to FIG. 2 showing the garment at a later stage of folding.
Figure 4:
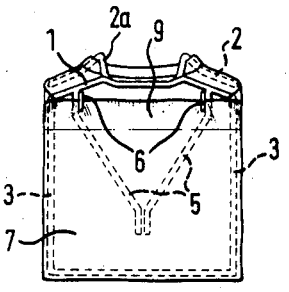
FIG. 4 shows the garment completely folded.

Turning first to FIG. 1, the display device shown comprises a first support element 1, as seen from the rear, on the forward side of the support element 1, there is provided a pair of second support elements 2 which are hingedly or rigidly fixed to the support element 1 and are adapted, as shown particularly in FIGS. 2, 3 and 4 to enter through the neck aperture of a garment such as a sweater and to pass beneath the shoulder portions thereof to attach the display device removably to the sweater with the support element 1 passing across the back of the garment in the shoulder area. For the display of shirts, the support elements 2 fit under the collar visibly or unseen at the top area of the shirt by means of a flexible form or by similar means at the zone 2*a*.

The support element 1 is continued to form a generally rectangular frame having side bars 3 and a bottom bar 4. Fixedly mounted on the shoulder parts of the support element 1 are a pair of oblique bars 5. Second support elements 2 may be in a plane offset from the support element 1 to allow display of different types of garment with varying thicknesses of fabric at the neck area. The ratio of dimensions of the elements 1, 3 and 4 will depend on size range of the garments to be displayed -at the one extreme menswear, at the other end babywear or similar.

Each bar has associated with it at least one latch or clip 6. Such latches or clips may be on, or in the region of, the support element 1 or located along the length of the bars 5.

In use, the second support elements 2 are introduced into the neck of the garment illustrated at 7 in FIGS. 2, 3 and 4. A first sleeve 8 of the garment 7 is then folded across the back of the garment beneath one bar 5 but along the other as illustrated in FIG. 2. The sleeve 8 is then folded down to the position shown in FIG. 3, using one bar 5 to form an oblique fold line to guide such folding. The second sleeve is then similarly treated so as to take up the position shown at 8*a* in FIG. 3. In this position, it will be seen that the sleeves 8 and 8*a* lie generally parallel with each other and with the sides of the garment 7. The side members 3 of the frame also have a function in ensuring that the sleeve is not folded too far across.

From the FIG. 3 position, a lower portion 9, illustrated with ribbing in FIG. 3, is folded up using the bottom bar 4 as a guide until the lower portion can be engaged with clips or latches 6 as illustrated in FIG. 4.

Figure 5:
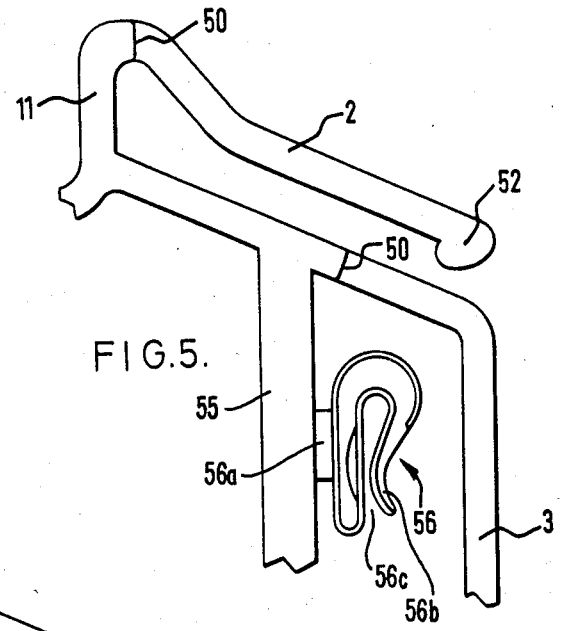
FIG. 5 shows a variant of part of FIG. 1.

FIG. 5 shows a variant of part of FIG. 1, more specifically of the upper right hand side as illustrated. The configuration of the bars 1, 2 and 3 is generally similar although as shown at 50 the support element 2 and the side bars 3 can lie slightly below the level of the central part of support element 1. Rounded end 52 helps the fitting of the display device into the neck. Clip 56 is integrally moulded and extends from an initial vertical portion of bars 5, being integrally connected thereto by a thinner portion 56*a*. The clip 56 can thus be bent for use at right angles to the general plane of the device, and its arcuate limb 56*b* and the resilient stem orificed at 56*c* ensures good retention.

Figure 6:
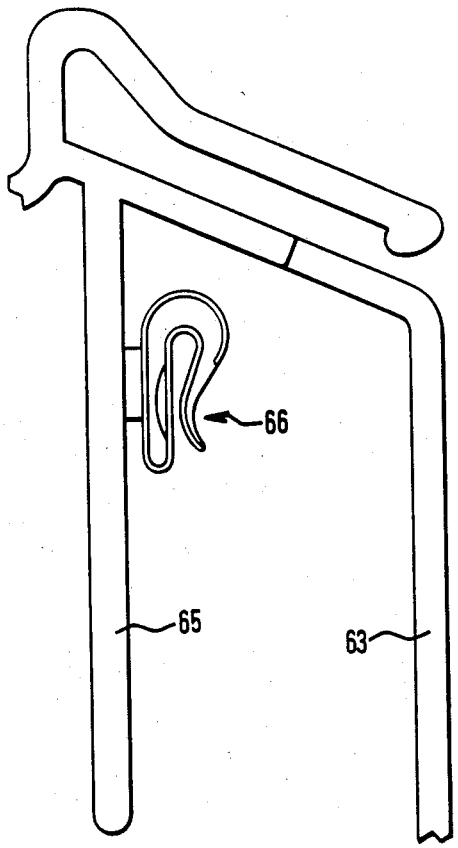
FIG. 6 shows another variant, of another part of FIG. 1.

FIG. 6 shows how a vertical bar 65 with a suitable clip 66 can replace oblique bar 5. For a cardigan, it will be found convenient to fold the sleeve under bar 65, back out to the edge at 63 and inward again. The folded-up garment portion generally retains these sleeve folds.

It will be appreciated that display devices not possessing any bars such as 5, 55 or 65 also fall within the scope of the invention.

Figure 7:
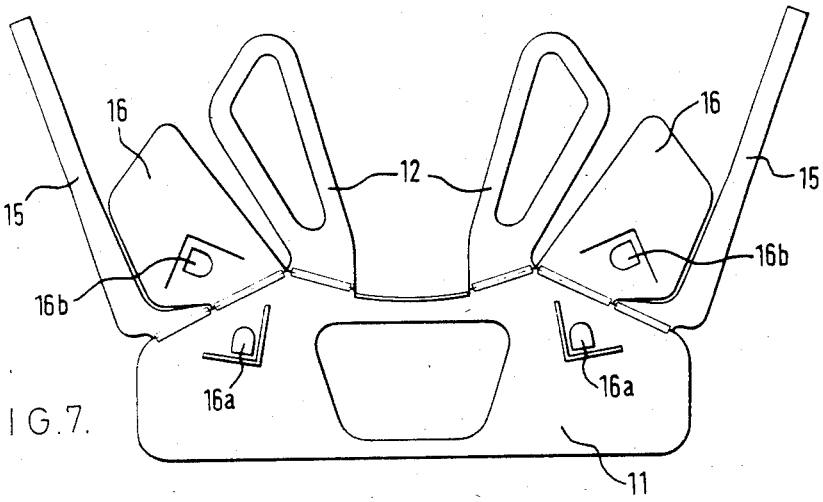
FIG. 7 is a rear elevational view of an alternate form of device in a completely unfolded position.
Figure 8:
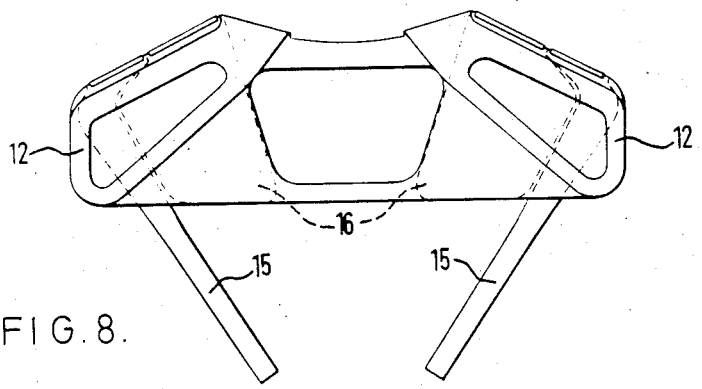
FIG. 8 is a front elevation of a device of FIG. 5 in a fully folded position.

FIGS. 7 and 8 show an alternative form of support or display device in which the frame 3 and 4 has been omitted and in which bars 15 are hinged. A principal support device is shown at 11, and hingedly attached thereto are a pair of second support elements 12 to enter the neck aperture of the garment when in the position shown in FIG. 8. Hinged bars 15 are shown in FIG. 7 in their free position and in FIG. 8 in the position in which sleeves can be folded about them. The principal support element 11 is provided with a pair of bosses 16*a* which cooperate with the apertures 16*b* on folded latch members 16 to engage and lightly hold the lower portion of a folded garment.

Figure 9:
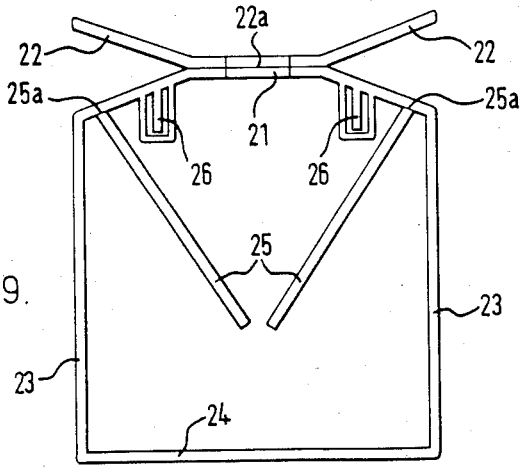
FIG. 9 shows a further alternative form of device.

FIG. 9 shows a still further alternative arrangement in which the second support element illustrated at 22 is hinged along a line 22*a* to the first support element 21. The first support element 21 is again extended by side frame elements 23 which lead into a lower frame element 24. Bars 25 are hinged about integral hinges 25*a* to the principal support element 21, and clips 26 are formed integrally with the principal support element 21 to receive the lower portion of a garment.

Various modifications may be made within the scope of the invention.

I claim:

1. A display device for garments comprising:

a first support element constructed of a transverse support having downwardly inclined upper surfaces extending towards opposite ends of said support, whereby said support is adapted to overlie the outer surface and to follow the contour of the shoulders of a garment;

a pair of second support elements arranged inclined downwardly and separately attached to the first support element inwardly of said downwardly inclined upper surfaces, whereby said second support elements are adapted to pass through a neck aperture of the garment so as to each be located in a shoulder zone and within the interior of the garment adjacent to one end of said first support element; and a pair of retaining means mounted on either side of the center of said first support element to receive and retain an upwardly folded lower region of the garment.

2. A display device as claimed in claim 1 in which the retaining means comprise clips.

3. The display device as claimed in claim 1, further including a pair of bars attached one to either side of the center of said first support element, each of said bars located in a position to define a fold line for return folding of a sleeve of the garment, said bars having a free end to facilitate the folding of a sleeve thereover.

4. A display device as claimed in claim 1 further comprising a pair of bars attached to the first support element and having a position so as to define a fold line for return folding of a sleeve.

5. A display device as claimed in claim 4 in which the bars are rigidly attached to the first support element.

6. A display device as claimed in claim 4 in which the said bars, over at least part of their length, each have an oblique orientation such that the sleeve can be return folded around one of said bars into substantially parallel relationship with a side of the garment and with the other sleeve.

7. A display device as claimed in claim 1, 4 or 6 in which the first support element is extended downwardly from its shoulder zone to form a frame and in which said frame includes a bottom bar around which the garment may be folded to bring the said lower region of the garment towards the retaining means.

8. A display device as claimed in claim 1, 4 or 6 in which the device is integrally moulded from a polymer material with the property of forming integral hinges.

* * * * *